US012410629B2

(12) United States Patent
Dawson

(10) Patent No.: US 12,410,629 B2
(45) Date of Patent: Sep. 9, 2025

(54) DEEP WATER STATIONARY WAVE SYSTEM AND METHOD

(71) Applicant: WHITEWATER WEST INDUSTRIES LTD., Richmond (CA)

(72) Inventor: Eliza Dawson, San Diego, CA (US)

(73) Assignee: WHITEWATER WEST INDUSTRIES LTD., Richmond (CA)

( * ) Notice: Subject to any disclaimer, the term of this patent is extended or adjusted under 35 U.S.C. 154(b) by 0 days.

(21) Appl. No.: 18/055,827

(22) Filed: Nov. 15, 2022

(65) Prior Publication Data

US 2024/0229488 A1 Jul. 11, 2024

Related U.S. Application Data

(60) Provisional application No. 63/264,096, filed on Nov. 15, 2021.

(51) Int. Cl.
*E04H 4/00* (2006.01)
*A63B 69/12* (2006.01)

(52) U.S. Cl.
CPC ..... *E04H 4/0006* (2013.01); *A63B 69/125* (2013.01)

(58) Field of Classification Search
CPC .. E04H 4/0006; A63B 69/0093; A63B 69/125
USPC ..... 405/79
See application file for complete search history.

(56) References Cited

U.S. PATENT DOCUMENTS 3,473,334 A 10/1969 Dexter et al.
6,460,201 B1 * 10/2002 Lochtefeld ..... E04H 4/0006 4/491
6,629,803 B1 10/2003 McFarland
6,738,992 B2 5/2004 Lochtefeld
6,928,670 B2 8/2005 Lochtefeld et al.
6,932,541 B2 8/2005 McFarland
7,326,001 B2 * 2/2008 McFarland ..... A63G 31/007 472/117
7,568,859 B2 8/2009 McFarland
7,658,571 B2 * 2/2010 McFarland ..... A63B 69/125 405/79

(Continued)

FOREIGN PATENT DOCUMENTS

ES 2843545 T3 * 7/2021 ..... E04H 4/0006
WO 2018083265 A1 5/2018

(Continued)

OTHER PUBLICATIONS

International Search Report and Written Opinion for International Application No. PCT/CA2022/051687, dated Feb. 15, 2023, 10 pages.

*Primary Examiner* — Frederick L Lagman
(74) *Attorney, Agent, or Firm* — Pillsbury Winthrop Shaw Pittman LLP

(57) ABSTRACT

A wave system is disclosed herein, including a water outlet, pumps, a controller for regulating the flow of water, an obstacle on the ride area floor capable of generating a surface contour of the water flowing over the ride area. The system may also include a variable surface in a reservoir, whereby the upper surface of the reservoir wall may be raised or lowered to affect the profile of the surface contour. Also disclosed is a training system for use with the wave system. A check valve cover is also provide to prevent backflow through inoperative pumps.

7 Claims, 15 Drawing Sheets

(56) References Cited

U.S. PATENT DOCUMENTS

| | | | | |
|---|---|---|---|---|
| 7,717,645 | B2 | 5/2010 | McLaughlin | |
| 7,722,291 | B2 | 5/2010 | McFarland | |
| 7,815,396 | B2 * | 10/2010 | McFarland | E04H 4/0006 4/491 |
| 8,303,213 | B2 * | 11/2012 | McFarland | A63G 31/007 405/79 |
| 8,496,403 | B2 * | 7/2013 | Lochtefeld | E04H 4/0006 4/491 |
| 8,516,624 | B2 * | 8/2013 | Klimaschewski | E04H 4/0006 4/491 |
| 8,523,484 | B2 * | 9/2013 | McFarland | A63G 31/007 405/79 |
| 8,602,685 | B1 * | 12/2013 | McFarland | A63G 31/007 405/79 |
| 9,144,727 | B2 | 9/2015 | Lochtefeld | |
| 9,777,494 | B2 | 10/2017 | Lochtefeld et al. | |
| 10,119,285 | B2 | 11/2018 | Perslow | |
| 12,084,882 | B2 * | 9/2024 | Dawson | A63B 69/0093 |
| 2007/0214560 | A1 * | 9/2007 | Chivers | A63B 69/125 4/488 |
| 2009/0169305 | A1 * | 7/2009 | Lochtefeld | A63G 31/007 405/79 |
| 2015/0089731 | A1 | 4/2015 | Lochtefeld | |
| 2016/0053504 | A1 | 2/2016 | Lochtefeld et al. | |
| 2018/0266129 | A9 | 9/2018 | McFarland | |
| 2021/0205685 | A1 * | 7/2021 | Jandke | A63B 69/0093 |
| 2021/0372152 | A1 * | 12/2021 | Abramov | E04H 4/0006 |
| 2024/0151054 | A1 * | 5/2024 | Dawson | E04H 4/0006 |

FOREIGN PATENT DOCUMENTS

| | | | |
|---|---|---|---|
| WO | 2018149969 | A1 | 8/2018 |
| WO | 2018188741 | A1 | 10/2018 |
| WO | 2019018573 | A1 | 1/2019 |
| WO | 2023082027 | A1 | 5/2023 |

* cited by examiner

DEEP WATER STATIONARY WAVE SYSTEM AND METHOD

CROSS REFERENCE TO RELATED APPLICATIONS

This application claims priority to U.S. provisional patent application Ser. No. 63/264,096, dated Nov. 15, 2021.

BACKGROUND

Water attractions have brought fun to different people from different geographic locations for many generations. The water attraction permits different geographic areas to have access to simulated experiences from other geographic areas. For example, a wave pool may approximate an experience at a beach.

Different water attractions may be used to approximate natural environments to permit users to experience sports and activities from these other environments. For example, sheet wave rides simulate a surfing or boogie boarding experience that permits a rider, with their body or a thin board, to ride upon a sheet flow of water that is contoured by an underlying ride area floor. The sheet wave ride does not provide a true surfing experience, as the sheet flow does not permit wave breaking or the use of an actual surfboard.

Deep wave surfing systems are provided that attempt to create a more accurate approximation of the surfing experience in the natural environment. Examples of wave systems may be found in, for example, U.S. Pat. Nos. 6,629,803; 6,738,992; 6,928,670; 6,932,541; 7,326,001; 7,568,859; 7,7,658,571; 7,717,645; 7,722,291; 7,815,396; 8,303,213; 8,496,403; 8,516,624; 9,144,727; 9,777,494; 10,119,285; United States Patent Publication Numbers 20150089731; 20160053504; 20180266129; and International Patent Application Publication Numbers WO2018083265; WO2018149969; WO2018188741; WO2019018573, all of which are incorporated by reference in their entirety herein.

SUMMARY

A wave system is disclosed herein. The wave system may include an obstacle in which water is pushed over to create a wave contoured surface for riding or maneuvering by a user.

The exemplary wave system may include an adjustable obstacle for changing the wave contoured surface of the water flowing over the obstacle. Exemplary embodiments may include a controller for adjusting the obstacle for desired configurations. In an exemplary embodiment, the obstacle may be static in position, and/or may be absent from the wave system entirely.

The exemplary wave system may include a declined surface extending from the water outlet toward the obstacle. The declined surface may be bounded by interior side walls. The interior side walls may be tapered, narrowing from a wider end near the water outlet to a narrower end adjacent the object. Exemplary embodiments may include different combinations of tapered and/or non-tapered interior side walls.

The exemplary wave system may include a water cycle in which water leaves the water outlet, over the obstacle, through a water drainage system, through a reservoir under the water ride area, and back to the water outlet. In an exemplary embodiment, the wave system may include a pump system in the reservoir under the ride area. The pump system may be position at or rearward of the obstacle and toward a rear of the wave system. The pump system may include a moveable mechanism for translating the pumps from a first position to a second position. The pump system moveable mechanism may be used to access the pumps for installation, maintenance, and/or replacement. Exemplary embodiments of the pump system may include pump inlets that are positioned toward a lower portion of the reservoir for drawing water into the pump from a bottom of the reservoir away from the water surface.

The exemplary wave system may include a water conditioner. Exemplary embodiments of the wave conditioner may be create by sheets having apertures therein. The sheets may be positioned in direct contact or may be positioned with gaps between adjacent sheets.

The exemplary wave system may include a water level controller in which a water level of the tail water or water level at the end of the wave near the water drainage area may be adjusted. The water level controller may be used to adjust the water level in the reservoir and in the area of the generated wave in order to adjust or effect the shape and/or size of the generated wave.

A BRIEF DESCRIPTION OF DRAWINGS

DESCRIPTION

The following detailed description illustrates by way of example, not by way of limitation, the principles of the invention. This description will clearly enable one skilled in the art to make and use the invention, and describes several embodiments, adaptations, variations, alternatives and uses of the invention, including what is presently believed to be the best mode of carrying out the invention. It should be understood that the drawings are diagrammatic and schematic representations of exemplary embodiments of the invention, and are not limiting of the present invention nor are they necessarily drawn to scale.

Exemplary embodiments described herein include a wave generation system and methods for generating a rideable wave.

Although embodiments of the invention may be described and illustrated herein in terms of a rideable wave, it should be understood that embodiments of this invention are not limited to any specific or required wave size and/or shape. As disclosed herein, exemplary embodiments may create different water surfaces, configurations, and experiences, all of which are within the scope of the instant disclosure. In addition, different features and combinations of structures, configurations, shapes, and components are provided as exemplary only. No feature, objective, or result is necessary to the invention, and therefore, no corresponding structure, component, or configuration is required or necessary to the invention. Instead, any combination of features, components, and configurations may be used in any combination and remain within the scope of the instant description. For example, any wave system described herein may be used with any described obstacle, wave conditioner, water level controller, pumps, declined surface, reservoir, water chambers, or without any one or more of these features and remain within the scope of the instant disclosure.

Figure 1:
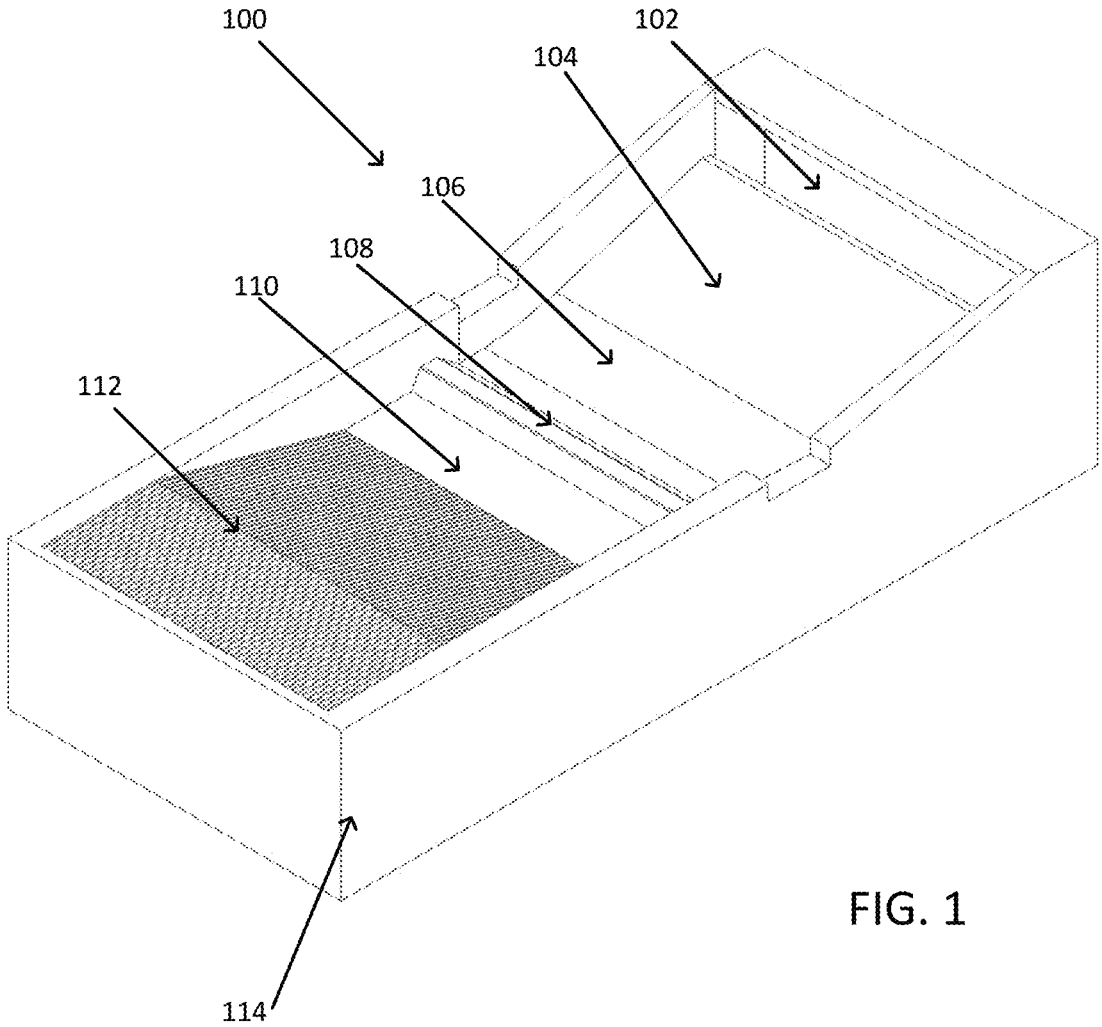
FIG. 1 illustrates a perspective view of an exemplary wave system according to embodiments described herein.

FIG. 1 illustrates an exemplary wave system according to embodiments described herein. The exemplary wave system 100 may include a water outlet 102 for introducing water onto a rideable area of the ride. The wave system 100 may include an obstacle 108. Water introduced onto the ride from the water outlet 102 may encounter the obstacle 108 to generate a contoured wave surface with the water. The contoured wave surface of the water (not shown) may be used as a rideable wave. The wave system 100 may include a water drainage system 112 to remove the water from the ride area and/or permit rider exit. The wave system 100 may also include a containment structure 114 for holding and containing the water and wave system components. As used herein, the term "ride area" is intended to encompass the upper portion of the ride attraction upon which water flows during operation. With reference to FIG. 1, the ride area would encompass the area from declined surface 104 to the end of the water drainage system 112.

As seen in FIG. 1, the obstacle 108 is positioned between the front of the wave system 100 where water is introduced at the water outlet 102 and the back of the wave system where water is removed at the water drainage system 112. As illustrated, the obstacle 108 may be connected or positioned relative to or integrated into the ride structure such that it forms a generally convex shape above a horizontal plane of a floor surface of the ride area. The obstacle 108 therefore defines a local maximum elevated surface relative to portions of the floor surface adjacent to the obstacle 108. The obstacle is configured to cause the water flowing thereover to back up creating a desired contoured wave surface for riding by a user.

Figure 8A:
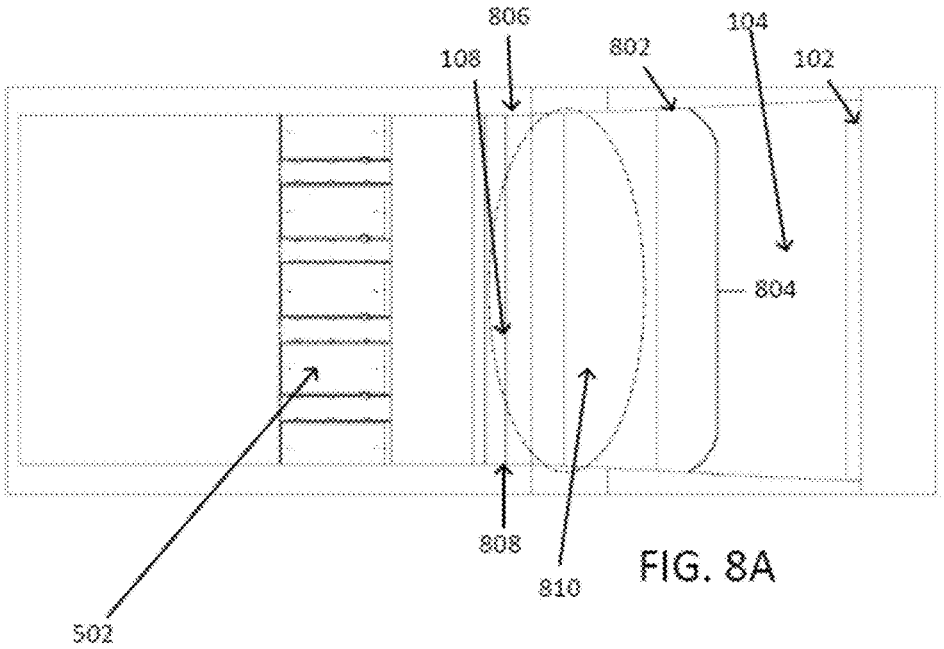
FIGS. 8A-8B illustrate top elevation views with components removed for visualization of components in a first and second position according to embodiments described herein.
Figure 8B:
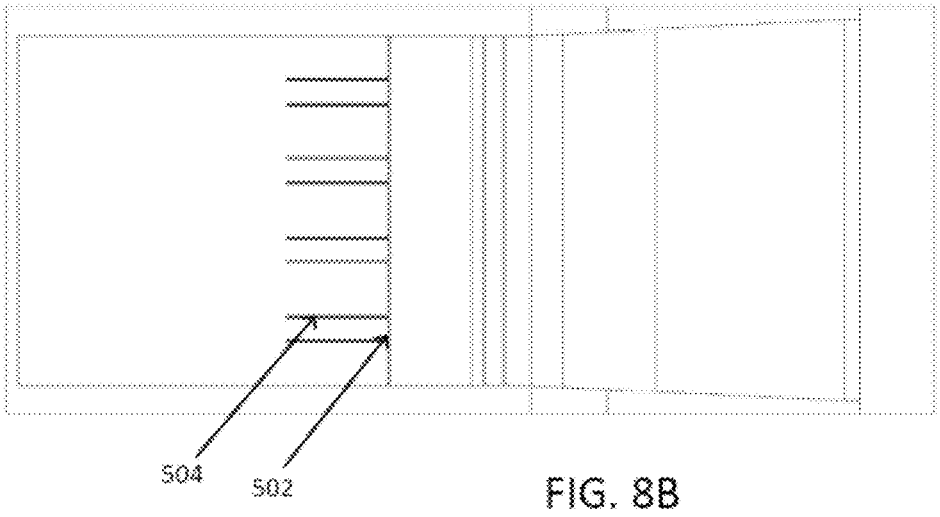

As seen in FIG. 1 and FIGS. 8A-8B, the obstacle 108 may extend transversely across at least a portion of the ride structure from one lateral side 806 to an opposing lateral side 808 of the rideable area 810. The rideable area 810 may be over the top of the ride structure over the obstacle, toward the water outlet 102 from the obstacle, and in the area adjacent the obstacle in which the contoured wave surface is created with the water flows thereover. The obstacle 108 may have a constant or variable cross sectional profile as the obstacle is traversed laterally across the rideable area. For example, as illustrated, the obstacle 108 defines an elevated surface that is the same across the ride area. Other configurations of the obstacle may also be used. For example, the obstacle may be separate segments that may be positioned adjacent one another across the rideable area. In an exemplary embodiment, more than one obstacle may be used, which may be positioned at different locations laterally (side to side) and/or longitudinally (front to back) on the rideable area. As another example, the obstacle may include a variable cross sectional profile as the obstacle is traverse laterally across the rideable area. For example, the obstacle may include a curvature is a horizontal plane, such that one portion of the obstacle may be positioned in front of or behind another portion of the obstacle relative to the water outlet 102. As described herein in more detail, exemplary embodiments may include the dynamic changing of the obstacle 108 shape, and/or obstacle location on the ride area.

Figure 2:
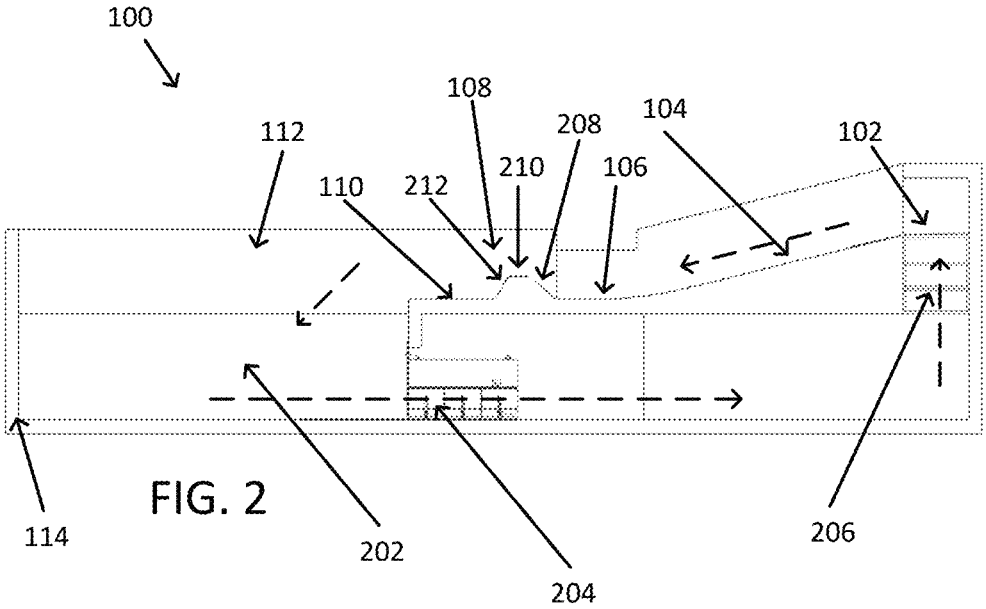
FIG. 2 illustrates a cross sectional view of an exemplary wave system according to embodiments described herein.

As more easily observed in FIG. 2, the obstacle can include one or more shaped surfaces. As illustrated, the obstacle may include a front surface 208, a transition surface 210, a rear surface 212, and any combination thereof. The front surface 208 may be an upwardly sloped surface above the ride floor, such as at transition surface 106 and/or 110. As illustrated, each of the front surface 208, transition surface 210, and rear surface 212 are planar. However, each surface may also be concave curved, convex curved, compound curved, or combinations thereof. As illustrated, each of the front surface 208, transition surface 210, and rear surface 212 are stepwise coupled creating a discontinuous surface encountered by the water as it flows over the obstacle 108. Exemplary embodiments may include curvatures on portions of and/or between the respective surface(s), transition segments, integration between segments, or contouring surfaces and/or layers across one or more segments to reduce the discontinuity and/or create a continuous surface from the front of the obstacle to the top of the obstacle or to the back of the obstacle.

In an exemplary embodiment, the wave system 100 may include a declined surface 104. The declined surface 104 may be positioned adjacent the water outlet 102. Exemplary embodiments may have the water outlet 102 at a higher elevation and the declined surface 104 is configured to move the water to a lower elevation before encountering the obstacle 108. The declined surface 104 may be configured to increase the velocity of the water encountering the obstacle. The declined surface 104 may be used to create a trough between the declined surface 104 and the obstacle 108 to influence the shape of the contoured wave surface created by the water. The wave system 100 may also include a transition surface between the declined surface 104 and the obstacle 108. The transition surface 106 may define a minimum elevation of a ride area floor. The transition surface 106 may be planar and horizontally level. The transition surface 106 may be contoured to transition the flow of water from the declined surface toward the obstacle.

As best illustrated by the top elevation view of the wave system and declined surface 104 of FIG. 8A, the declined surface may have opposing interior walls 802. The interior walls 802 may contain the flowing water from the water outlet and down the declined surface 104. As illustrated, the opposing interior walls may be inwardly tapered from a first end toward the water outlet 102 toward a second end toward the obstacle 108. A cross-wise, lateral distance between opposing interior walls 802 defines an interior diameter 804 of the declined surface 104. As illustrated, the diameter 804 of the declines surface 104 is greater proximate the water outlet 104 and lesser proximate the obstacle 108. The taper may extend from adjacent the water outlet 102 near the obstacle 108, to a beginning edge of the obstacle 108, near the maximum elevated portion of the obstacle, or after the obstacle. In an exemplary embodiment, the tapering of the opposing interior walls 802 may be used to reduce sidewall effects on the water as the water flows down the declined surface 104. For example, the frictional effects of the sidewall may cause turbulence and white-water to occur near the interior walls of the ride. The tapering may be used to increase the speed of the water and minimize the sidewall effects. The tapered sidewalls may therefore be used to reduce the appearance of turbulence in the flowing water to create a smoother, glassier water surface. The interior walls 802 may be tapered along an entire length of the declined surface or any portion thereof. For example, the interior walls 802 may include a parallel or non-tapered portion adjacent the water outlet, but a tapered portion toward the obstacle end of the declined surface. In an exemplary embodiment, the walls may interior walls 802 may also be inwardly or outwardly tapered as the interior wall is traversed upward in elevation above the ride area floor. For example, the interior walls 802 may be angled inwardly or outwardly from the vertical plane.

Referring back to FIG. 1, the wave system may include a water drainage system 112. As illustrated, the water drainage system 112 may be positioned on an opposite side of the obstacle 108 than the water outlet 102. The water drainage system 112 may remove the water from the ride area floor or from the ride area. In an exemplary embodiment, the water drainage system 112 may recycle the water back to the water outlet 102. For example, the water drainage 112 may include a portion of the ride area floor having apertures or passages there through for permitting the passage of water from the ride area to an area below the ride area floor. Other drainage systems may be used, such as drainage surface on the lateral sides and/or the tops of the lateral sides of the sidewalls of the ride structure. Any combination of drainage features may be used in any combination. As illustrated, the wave system 100 may include a transition surface 110 between the obstacle 108 and the drainage system 112.

As illustrated, the water drainage system 112 may include an inclined surface. The inclined surface may be configured such that a user may exit the ride area by walking on the inclined surface out of the water. The inclined surface may therefore be textured, contoured, shaped, or through the apertures create an increased frictional surface for easier standing and walking by the user. The drainage system 112 may also include an extended rear section. This area may be used to slow a rider, permit spectator viewing, permit operator positioning and/or availability for assistance of users, and combinations thereof. As the water drainage system may be impacted by the user after riding the contoured wave surface of the water generated by the obstacle, the water drainage system may be padded or have other impact resistant features. In an exemplary embodiment, the water drainage system may have a flexible covering and/or surface.

As illustrated in FIG. 1, the wave system 100 may include a containment structure 114. The containment structure 114 may contain the water within system. The containment structure may provide structural support for one or more components of the wave system 100. In an exemplary embodiment, the containment structure is sufficiently strong to retain and the amounts of water for the ride operation. In an exemplary embodiment, the containment structure 114 is configured to retain water below the ride area. The containment structure may therefore define a reservoir for passing water received from the drainage system 112 under the ride area back to the water outlet 102. As described more fully herein, the reservoir below the ride area may include one or more pumps for moving water as described herein. In an exemplary embodiment, the containment structures is concrete. In an exemplary embodiment portions or all of the ride area floor and/or containment structure may be concrete. For example, the declined surface 104 may include a concrete under layer to support the flowing water from the water outlet 102. The containment structure, and/or portions of the wave system may include one or more access panels and/or doors to allow access to components and/or locations within the wave system structure.

Figure 3:
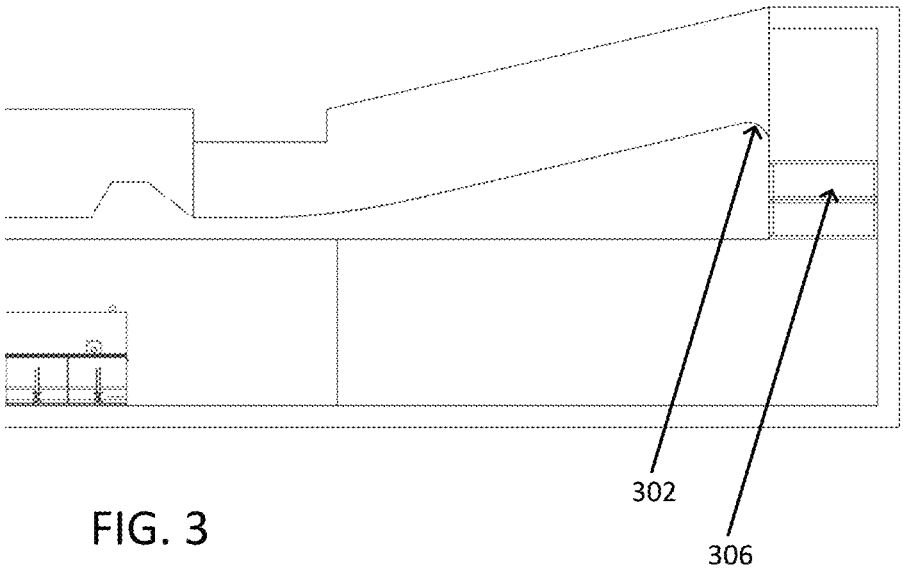
FIG. 3 illustrates a partial cross sectional view of an exemplary wave system according to embodiments described herein.

FIGS. 2-3 illustrate cross sectional views of an exemplary wave system according to embodiments described herein. As illustrated by the dashed lines of FIG. 2, the water may be circulated from the water outlet 102, down the declined surface 104 to encounter the obstacle 108 and create the contoured wave surface with the water, to drain through the drainage system 112 to be moved through the reservoir 202 by nozzles 204.

Exemplary embodiments may also include water filters. Water filters may be used to reduce debris in the system that may clog the nozzles and/or create obstacles for riders while they are within the ride area. In an exemplary embodiment, the water drainage system 112 may provide a first filter. As described herein, the water drainage system 112 may include a porous to permit water to pass there through. The water drainage system 112 may be configured to filter out materials larger than a desired size. For example, the water drainage system 112 may be used to keep a person, body parts, clothing, shoes, boards, riding vehicles, bracelets, watches, phones, cameras, wallets, and other objects that may be lost by a user while riding the wave system. One or more filters may also be positioned on an inlet and/or outlet side of the nozzle 204. One or more filters may also be positioned before or proximate to the water outlet 102. The filters may be removable and/or replaceable for maintenance and/or easy cleaning. The filters at the nozzles may be supported by the nozzles for access according to embodiments described herein.

Exemplary embodiments may also include one or more water conditioner 206, 306. The water conditioner 206, 306 may be positioned adjacent a water outlet 102. The water conditioner may be configured to reduce turbulence in the water flow. Exemplary water conditioner may include a system of apertures for passing the water. For example, a conditioner may include a planar structure including a plurality of apertures therein. The conditioner may include a mesh, expanded metal, net, or other configuration. Exemplary embodiments of a conditioner is described in more detail herein in reference to FIG. 9.

As described herein, the water conditioners and/or position of the pumps may be used to reduce turbidity of the water coming from the water outlet. For example, as the water travels from the pumps, the water turbidity may be reduced. Therefore, the further the pumps are from the water outlet, the less turbidity there may be in the water outlet. However, the further the pumps are from the water outlet, the more power is required to push the water through the system. The conditioners may also be used to reduce turbidity in the water. However, the more conditioners that are present or the more interference to the cross sectional area of the water passage, the more power is required to push the water through the conditioners.

As shown and described herein, the wave system 100 may include one or more surfaces for supporting, containing, and/or moving water. The surfaces illustrated herein are generally planar surfaces creating discontinuity between one surface area to an adjacent surface area. The invention is not so limited. Instead, surfaces may include fillets or other tapered, curved, or transitional area to reduce the discontinuity between surfaces, and/or create a continuous transition from one surface to an adjacent surface. The transition may be accomplished through contouring of either or both of the adjacent surfaces. The transition between surfaces may be through one or more layers or coatings between adjacent surfaces. For example, as seen in FIG. 3, a fillet 302 may be used at a surface transition between the reservoir and the water outlet 302. The fillet 302 may be a curved surface to create a continuous transition between an upwardly extending wall from the reservoir to the downwardly inclined declining surface to the ride area.

The surfaces shown and described herein may include additional features, such as surface coatings, drainage features, additional layers, and combinations thereof. The additional features may be to reduce the effects of impact by a user or reduce injury during the ride experience through contact with the surface. The additional feature may include foam or other padding. The additional features may be to reduce the impacts of the environment on the wave system or system components. For example, additional features may include UV resistant, water resistant, chlorine resistant, etc. protections and/or coatings. Additional features may include sealants to reduce water penetration into parts of the system. Additional features may include frictional engagement or frictional reducing structures, coatings, and/or layers. Exemplary portions of the system may benefit from reduced friction, such as at or along the declined surface 104, while portions of the system may benefit from increased friction, such as at or along the drainage system 112. Any combination of additional features may be used with any features described herein.

Figure 4A:
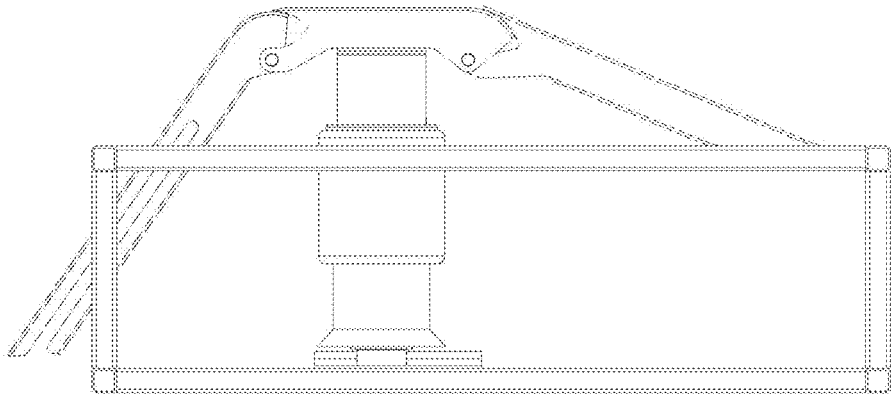
FIGS. 4A-4B illustrates a partial cross sectional view of components of an exemplary wave system according to embodiments described herein.
Figure 4B:
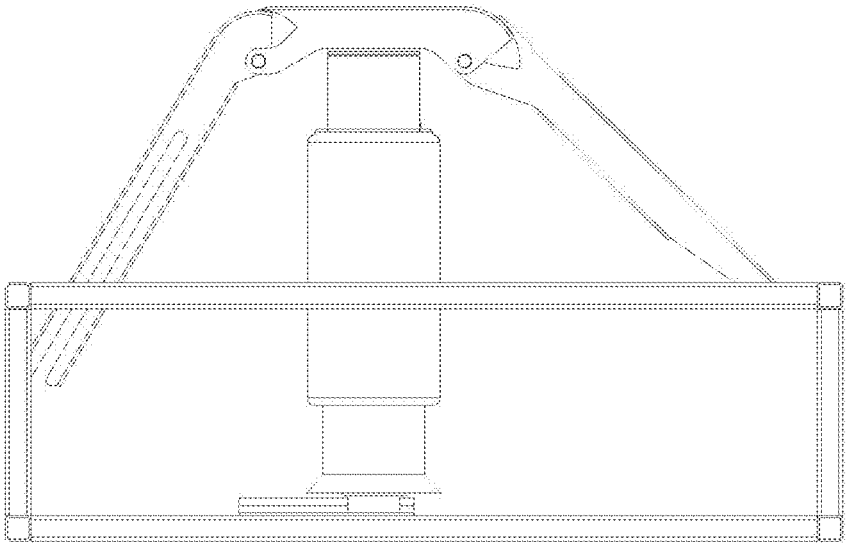

FIGS. 4A-4B illustrate an exemplary view of an exemplary embodiment of an adjustable obstacle described in a related application. In an exemplary embodiment, the obstacle 108 is deformable such that the obstacle may present a different cross sectional front profile to oncoming water. The size of the obstacle front profile may be used to vary or change the contoured wave surface created with the water flowing over the obstacle 108.

Figure 10:
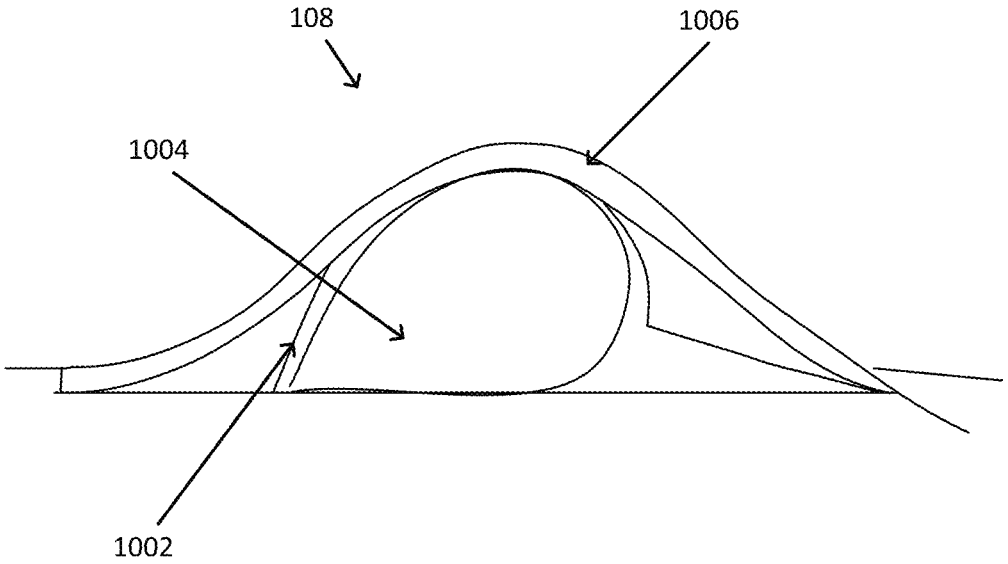
FIG. 10 illustrates a variable structure for creating a wave according to embodiments described herein.

FIG. 10 illustrates an exemplary embodiment of an obstacle 108 according to embodiments described herein. As illustrated, the obstacle 108 includes an actuator for adjusting a profile, shape, orientation, height, angle of attack for inbound water, or a combination thereof. As illustrated, the actuator may be a bladder 1002 that is filled with a substance 1004 to inflate or change the contour, profile, shape, orientation, height, angle of attack, or any combination thereof. The bladder 1002 may be configured with one or more valves for permitting the substance to enter the bladder as well as vacate the bladder. The substance may be air, liquid, or solid.

As illustrated in FIG. 10, the obstacle may include a cover layer 1006. The cover layer may be used to provide a smoother transition for the passage of water over the obstacle than the actuator and/or other obstacle components without the layer would provide. The layer may be used to provide surface characteristics, such as a smoother, reduced frictional surface for passage of water there over. In an exemplary embodiment, the cover layer may be configured such that a length of a surface encountered by flowing water from the front of the layer or obstacle to the back of the layer or obstacle can be changed as the obstacle is changed according to embodiments described herein. For example, the cover layer may extend into and out of a surface of the wave system as the bladder is deflated and inflated, respectively. The cover layer may be elastic or stretchable thereby providing the necessary deformation for expansion by the bladder. The cover layer may be overlapping or telescoping, pleated, or otherwise deformable to permit the desired actuation to change the obstacle as described herein. The obstacle may include one or more additional surfaces for providing increased rigidity and/or a desired surface to encounter the water. The surface may be planar, curved, complex curved, or a combination thereof.

Exemplary embodiments may include a controller coupled to the actuator 422 for controlling a shape of the obstacle 108. Changing a shape of the obstacle may include any combination of a change in a front profile of the obstacle, a height of the obstacle, a slope of one or more surfaces of the obstacle, a cross sectional profile of the obstacle, an orientation of the obstacle and/or any component part of the obstacle, etc. The controller may be configured to dynamically control a position and/or shape of the obstacle. The controller may permit a user to select a position and/or shape of the obstacle. The controller may permit a user to select a skill level, such as beginner, intermediate, and experienced. The controller may thereafter position the obstacle at a corresponding shape associated with the selection of the skill level. The controller may also include a programmer. The programmer may include a schedule that permits a user to select an obstacle shape at desired times, intervals, etc. The programmer may communicated with the actuator to adjust or change the obstacle shape according to the desired or entered schedule. The controller may also be configured to adjust the shape of the obstacle based on the operational time of the wave system. For example, during start up or shut down, the shape, such as the height, of the obstacle may be minimized. The reduction in the obstacle may permit the water to flow over the obstacle more easily and reduce the start-up water agitation. Once the water has run for a predetermined amount of time, the obstacle may be increased in size so that the contoured water surface may be created.

In exemplary embodiments, the wave system may also include a controller for adjusting an amount of water through the pumps. The controller of the pump may adjust a flow rate of the pump. The combination of either or both of the adjustments to the obstacle and/or the pump flow rates may be used to change the contoured wave surface of the water. The adjustment to the contoured wave surface of the water may be used to provide different ride experiences. The adjustment to the pump flow rate and/or obstacle shape may be used to create a contoured wave surface to correspond with an experience level of the user.

Referring back to FIG. 2, exemplary embodiments of the wave system 100 includes an obstacle 108 for creating a contoured wave surface with the water for riding or performing maneuvers by a user. As described herein the obstacle 108 may be positioned around a central area of the ride structure. In an exemplary embodiment, the nozzle 204 positioned below the ride area may be proximate to, in line with, or rearward (on a side opposing the water entry and toward the water drainage system) of the obstacle 108. Exemplary embodiments may include a removable water drainage portion. The wave system may therefore permit access to the reservoir 202 through all or a portion of the water drainage surface. By positioning the water pumps rearward of the obstacle, the pumps may be closer to, proximate to, or under a portion of the water drainage surface. The nozzles may therefore be easier to access for replacement, installation, and/or maintenance. As described herein, exemplary portions of the containment structure 114, and/or surfaces 104, 106, 110 may be concrete. Therefore, access under or through these surfaces may be difficult. Access through the removable pump system may therefore improve case of access without weakening or compromising the structural infrastructure and/or complicating the infrastructure. However, access panels may also be provided in the wave system. For example, access panels may be provided through the ride area floor and/or through exterior wall sin order to access areas that may include components parts, such as filters.

Figure 5:
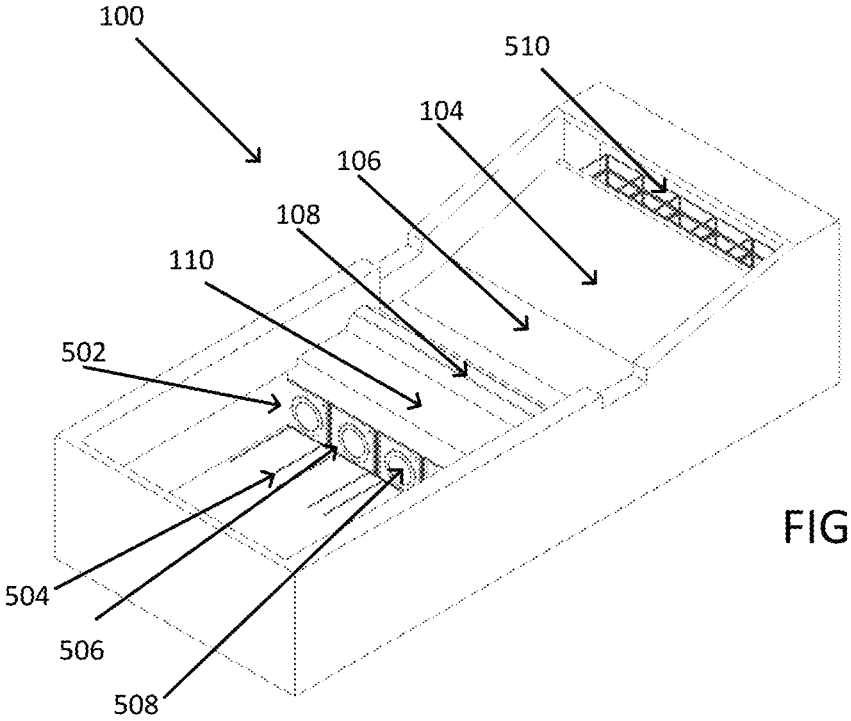
FIG. 5 illustrates a perspective view with component parts removed for visualization of an exemplary wave system according to embodiments described herein.
Figure 6:
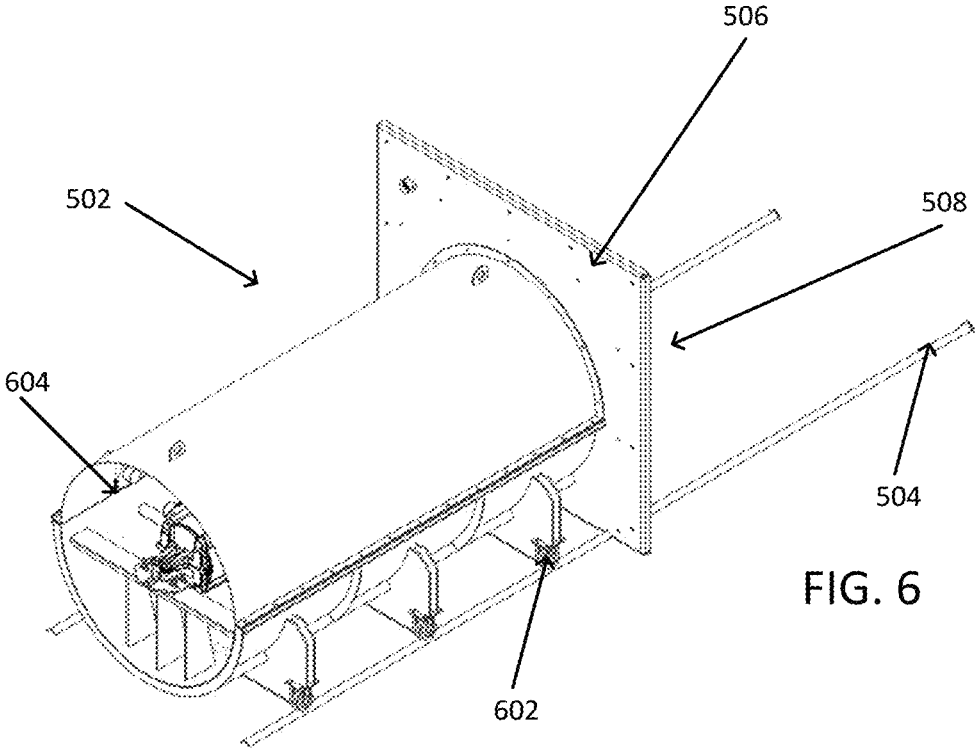
FIG. 6 illustrates a perspective partial component view for use with an exemplary wave system according to embodiments described herein.

FIG. 5 illustrates a perspective view of the wave system 100 with the water drainage system surface portion removed to permit viewing of the nozzles positioned thereunder. FIG. 6 illustrates a perspective view of an exemplary nozzle according to embodiments described herein for use in an exemplary wave system. As illustrated, a portion of the nozzles may extend rearward or be positioned proximate to the end of the concrete portion of the containment structure defining a portion of the ride area floor (surfaces 110 and/or 106).

As illustrated, in an exemplary embodiment, the pump system 502 may include a water inlet 508 and water outlet 604. The water inlet 508 may be configured to draw water from a lower portion of the reservoir. As illustrated, the water inlet 508 includes a front surface 506. The front surface 506 may be configured to attach or couple to the infrastructure of the wave system. The pump system 502 may be configured to draw water from the reservoir near the top, middle, bottom, or a combination thereof of the reservoir. In an exemplary embodiment, the system may be configured to draw toward the bottom of the reservoir. Water from the top surface of the water level within the reservoir may be aerated and/or may draw in air from above the surface of the water level. In some cases, if the water is pulling from the water surface into the water inlet 508 of the pump 502, the system may pull in air from the water surface. This may occur if a vortex from the water surface is created at the water inlet into the pump. When this air is pulled through the pump and ejected with the water onto the ride area floor, it may cause cavitation. The pump may include components to reduce the cavitation of the system by limiting the air being pulled from a surface of the water. For example, the pump may include a lip (not shown) that extends over a top of the water inlet 508. The lip may reduce the water directly pulled from the surface and reduce a corresponding amount of air into the pump system. Other features may also be used to direct the water from lower in the water column. For example, tubes or other passages may be used to direct water from a desired location within the water column. These components and features may be selected based on the water level and the clearance of the system above the ground of the reservoir. The wave system may also include an intermediate layer between the water drainage system and the reservoir that may reduce the aeration of the water before it enters the pumps. Such layers may include surface structures at the top of the reservoir, or other intermediate structure to reduce the impact of the water returning from the ride area floor to the reservoir to reduce the churning and/or incorporation of air into the water within the water column of the reservoir before the water enters the pump(s).

As illustrated, the pumps 502 may be moveable relative to the containment structure. In an exemplary embodiment, the relative movement may be achieved or facilitated through the use of a movement system. In an exemplary embodiment, the relative movement may be achieved through the use of rollers 602 and/or tracks 504. As illustrated, the pumps 502 may include a plurality of rollers 602 to support the pumps. The rollers 602 may be positioned on corresponding tracks 504 to control the relative position and movement of the rollers. Although rollers on tracks are illustrated as an exemplary movement system, other system may be used, such as telescoping rails, sliders, or other systems for linear translation of component parts. Although linear translation is shown and describe, and specifically a single axis translation along rails, the invention is not so limited. Other systems may be used. For example, a two-axis linear translation system like a gantry system may be used. Other configurations may permit translation in a first direction then followed by translation in a second direction. This configuration may permit the pumps to act like an access panel, pulling them out and then over to permit an opening under the ride area floor. Other configurations and movement platforms are also considered herein.

Figure 7A:
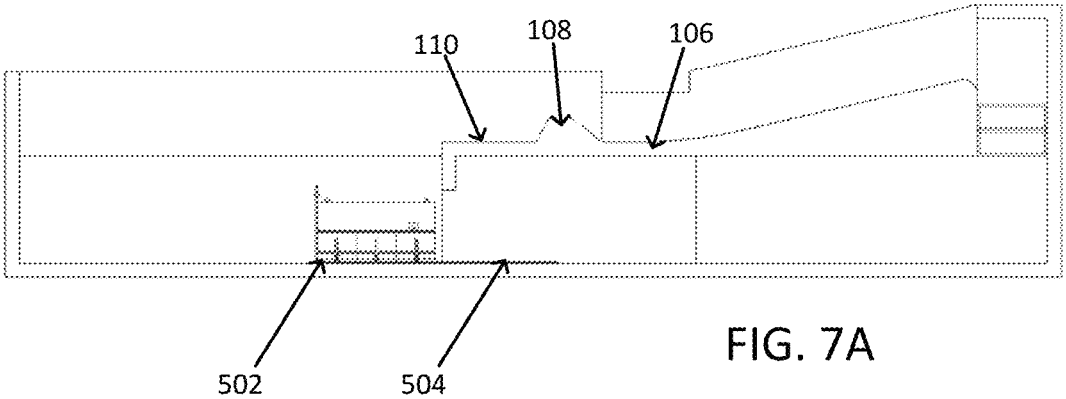
FIGS. 7A-7B illustrate a cross sectional view of components of an exemplary wave system in a first and second position according to embodiments described herein.
Figure 7B:
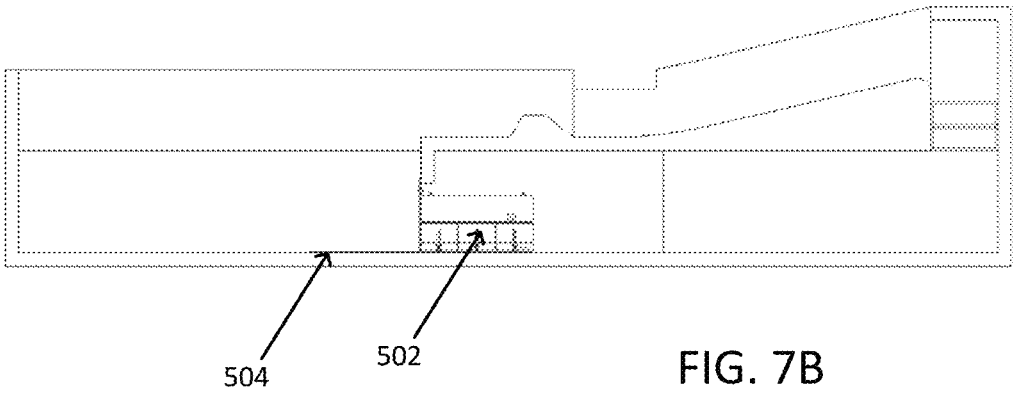

Exemplary embodiments of the wave system 100 according to embodiments described herein may include a pump system having a first position and a second position. FIGS. 7A-7B illustrate a cross sectional view of the wave system in which the pumps are in a first and second position. FIGS. 8A-8B illustrate a top elevation view of the wave system with the water drainage portion removed to permit viewing of the pumps in the first and second position, as described herein. In an exemplary embodiment, the first position of the pump (as seen in FIGS. 7B and 8B) may be an in use position. The pump 502 may be positioned in a forward position toward the water outlet 102. In an exemplary embodiment, the forward position may be with a portion or all of the pump positioned under or proximate a portion of the containment structure or ride structure, such as surface 110, surface 106, obstacle 108, or combinations thereof. The pumps may be secured into the first position such as by lock on movement system, bolting or other attachment of the pump structure to the infrastructure, such as portions of the containment structure 112, or combinations thereof. The second position of the pump (as seen in FIGS. 7A and 8A) may be in an exposed configuration. The second position may be rearward (away from the water outlet 102) than the first position. The second position may exposed a portion or all of the pump structure. The second position may therefore improve efficiencies for repair, replacement, installation, and combinations thereof.

Figure 9:
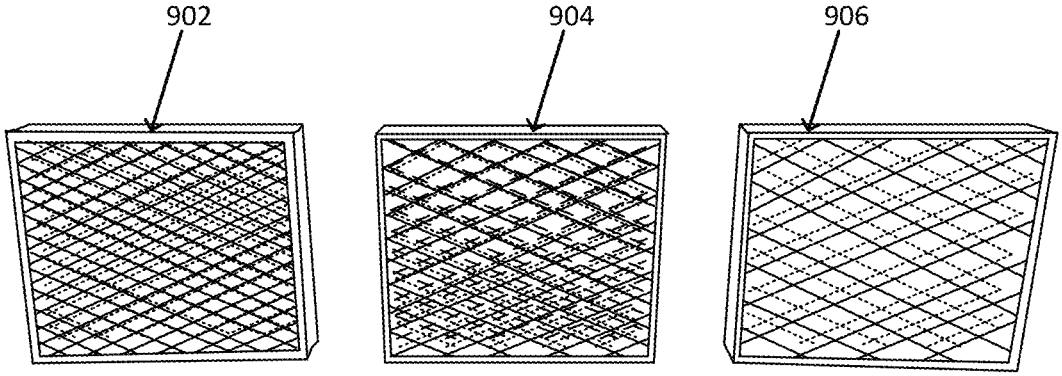
FIG. 9 illustrates exemplary water conditioners according to embodiments described herein.

Referring back to FIG. 2-3, or 5, exemplary embodiments of a wave system described herein may include a water conditioner 206, 306, 510. FIG. 9 illustrates exemplary components of a water conditioner according to embodiments described herein. Exemplary embodiments of a water conditioner include a plurality of sheets having apertures there through. Adjacent sheets of the plurality of sheets may be separated by a gap. The front sheet is illustrated for sake of clarity as solid lines, while sheets removed from the front surface are illustrated in dashed lines. The plurality of sheets may therefore define parallel planes that have a separation gap there between. Exemplary embodiments may have the same or different separation gaps between different adjacent sheets. In an exemplary embodiment, different sets of sheets may be coupled together. For example, a first set of sheets 902 may be coupled together, a second set of sheets 904 may be coupled together and a third set of sheets 906 may be coupled together. Different sets of sheets may thereafter be stacked to create a water conditioner. As illustrate, the aperture size, configuration, position, shape, orientation, and combinations thereof may be different between two or more sheets or set of sheets. In an exemplary embodiment, different aperture sizes, orientations, shapes, or other configuration is used between two or more sheets. With the variability between sheets, the apertures and structure defining the apertures will overlap between the different sheets. The overlap between the different sheets may therefore create a small mesh size or overall aperture size so that the water has a higher probability of contacting a sheet structure as it traverses from one end of the conditioner to another. As illustrated, the sheets may be crated from expanded metal. Metals sheets may have slits cut therein. The metal is then expanded to create the different aperture size and shapes. FIG. 2 illustrates and exemplary embodiment in which three sets of panels are used having different configurations, while FIG. 3 illustrates 2 sets of panels are used, in which each panel includes a plurality of sheets having apertures there in.

Figure 11:
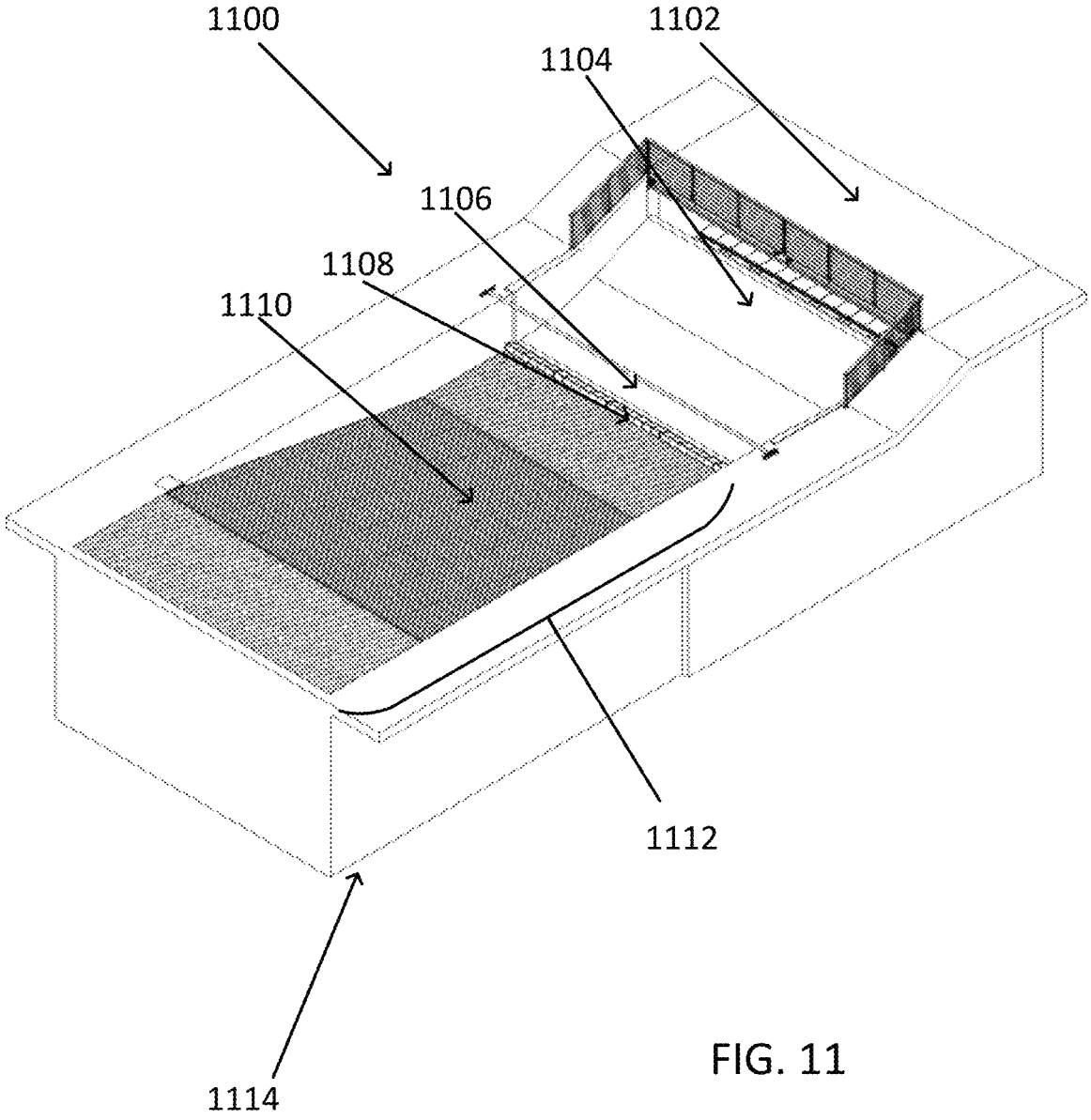
FIG. 11 illustrates a deep wave system according to embodiments described herein.

FIG. 11 illustrates an exemplary wave system according to embodiments described herein. The exemplary wave system 1100 may include a water outlet 1102 for introducing water onto a rideable area of the ride. The wave system 1100 may include an obstacle 1108. Water introduced onto the ride from the water outlet 1102 may encounter the obstacle 1108 to generate a contoured wave surface with the water. The contoured wave surface of the water (not shown) may be used as a rideable wave. The wave system 1100 may include a water drainage system 1112 to remove the water from the ride area and/or permit rider exit. The wave system 1100 may also include a containment structure 1114 for holding and containing the water and wave system components.

In an exemplary embodiment, the wave system 1100 may include a declined surface 1104. The declined surface 1104 may be positioned adjacent the water outlet 1102. Exemplary embodiments may have the water outlet 1102 at a higher elevation and the declined surface 1104 is configured to move the water to a lower elevation before encountering the obstacle 1108. The declined surface 1104 may be configured to increase the velocity of the water encountering the obstacle. The declined surface 1104 may be used to create a trough between the declined surface 1104 and the obstacle 1108 to influence the shape of the contoured wave surface created by the water. The wave system 1100 may also include a transition surface between the declined surface 1104 and the obstacle 1108. The transition surface 1106 may define a minimum elevation of a ride area floor. The transition surface 1106 may be planar and horizontally level. The transition surface 1106 may be contoured to transition the flow of water from the declined surface toward the obstacle.

As seen in FIG. 11, the obstacle 1108 is positioned between the front of the wave system 1100 where water is introduced at the water outlet 1102 and the back of the wave system where water is removed at the water drainage system 1112. As illustrated, the obstacle 1108 may be connected or positioned relative to or integrated into the ride structure such that it forms a generally upwardly angled projection above a horizontal plane of a floor surface of the ride area. The obstacle 1108 therefore defines a local maximum elevated surface relative to portions of the floor surface adjacent to the obstacle 1108. The obstacle is configured to cause the water flowing there over to back up creating a desired contoured wave surface for riding by a user.

The obstacle 1108 may extend transversely across at least a portion of the ride structure from one lateral side to an opposing lateral side of the ride area. With reference to the embodiment in FIG. 12, the ride area would encompass the area from and including declined surface 1104 to the end of the water drainage system 1112. The obstacle 1108 may have a constant or variable cross sectional profile across the rideable area. For example, as illustrated, the obstacle 1108 defines an elevated surface that is the same across the ride area. Other configurations of the obstacle may also be used.

Figure 12:
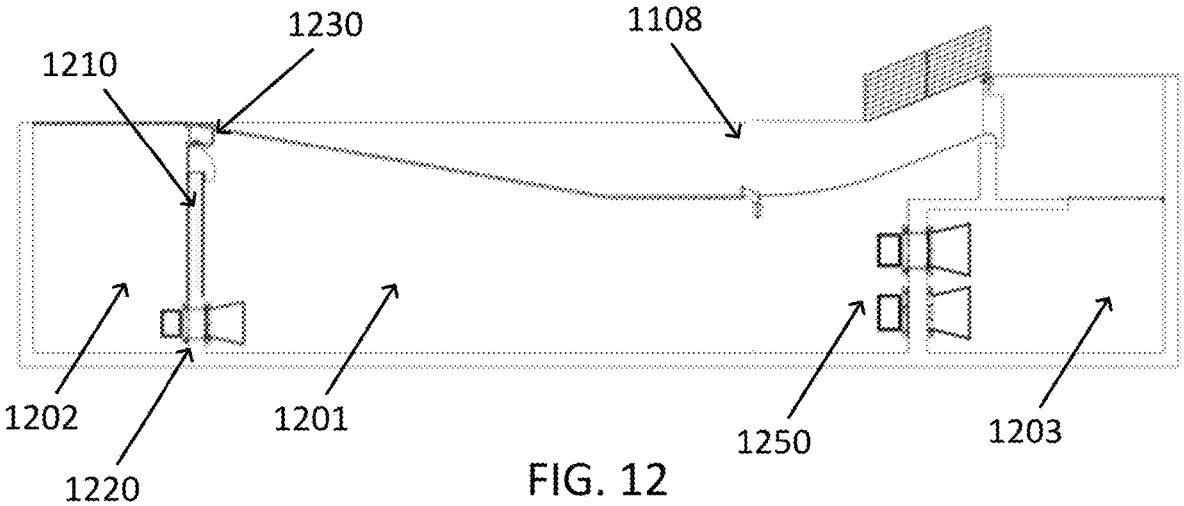
FIG. 12 illustrates a cross sectional view of the deep wave system according to embodiments described herein.

As more easily observed in FIG. 12, the obstacle 1108 can include one or more generally planar or shaped surfaces. As illustrated, the obstacle 1108 may include a front surface and a back surface, and any combination thereof. The front surface may be an upwardly sloped surface above the ride floor, such as at transition surface 1106. Exemplary embodiments may include curvatures on portions of and/or between the respective surface(s), transition segments, integration between segments, or contouring surfaces and/or layers across one or more segments to reduce the discontinuity and/or create a continuous surface from the front of the obstacle to the top of the obstacle or to the back of the obstacle.

Referring back to FIG. 11, the wave system may include a water drainage system 1112. As illustrated, the water drainage system 1112 may be positioned on an opposite side of the obstacle 1108 than the water outlet 1102. The water drainage system 1112 may remove the water from the ride area. In an exemplary embodiment, the water drainage system 1112 may recycle the water back to the water reservoir and subsequently back to the water outlet 1102. For example, the water drainage 1112 may include a portion of the ride area floor having apertures or passages there through for permitting the passage of water from the ride area floor to the reservoir. Other drainage systems may be used, such as drainage surface on the lateral sides and/or the tops of the lateral sides of the sidewalls of the ride structure. Any combination of drainage features may be used in any combination. As illustrated, the surface after the obstacle 1108 may comprise a drainage area. The surface may therefore include apertures that permit the flow of fluid through but may be small enough to permit a user to stand, walk, or otherwise be kept from passing there through. As illustrated, the drainage surface is shown in cross hatching.

As illustrated, the water drainage system 1112 may include an inclined surface 1110, a lower surface, and an upper surface. The inclined surface may be configured such that a user may exit the ride area by walking on the inclined surface out of the water. The inclined surface may therefore be textured, contoured, shaped, or otherwise create an increased frictional surface for easier standing and walking by the user. The drainage system 1112 may also include an extended rear section. This area may be used to slow a rider, permit spectator viewing, permit operator positioning and/or availability for assistance of users, and combinations thereof. As the water drainage system may be impacted by the user after riding the contoured wave surface of the water generated by the obstacle, the water drainage system may be padded or have other impact resistant features. In an exemplary embodiment, the water drainage system may have a flexible covering and/or surface.

As illustrated in FIG. 11, the wave system 1100 may include a containment structure 1114. The containment structure 1114 may contain the water within the system. The containment structure 1114 may provide structural support for one or more components of the wave system 1100. In an exemplary embodiment, the containment structure is sufficiently strong to retain and the amounts of water for the ride operation. In an exemplary embodiment, the containment structure 1114 is configured to retain water within and below the ride area. The containment structure may therefore define a reservoir for passing water received from the drainage system 1112 under the ride area back to the water outlet 1102. As described more fully herein, the reservoir below the ride area may include one or more pumps for moving water as described herein. In an exemplary embodiment, the containment structure 1114 is concrete. In an exemplary embodiment all or a portion of the ride area floor may be fiberglass. Alternatively, portions of the ride area floor may be concrete covered with a cushioned material such as neoprene or foam. The containment structure, and/or portions of the wave system may include one or more access panels and/or doors to allow access to components and/or locations within the wave system structure.

The water may be circulated from the water outlet 1102, down the declined surface 1104 to encounter the obstacle 1108 and create the contoured wave surface with the water, to drain through the drainage system 1112 to be moved through the reservoir by pumps, as shown in FIG. 11. In exemplary embodiments, the wave system may also include a controller for adjusting an amount of water through the pumps. The controller of the pump may adjust a flow rate of the pump. The combination of either or both of the adjustments to the obstacle and/or the pump flow rates may be used to change the contoured wave surface of the water. The adjustment to the contoured wave surface of the water may be used to provide different ride experiences. The adjustment to the pump flow rate and/or obstacle shape may be used to create a contoured wave surface to correspond with an experience level of the user.

Exemplary embodiments described herein may include a mechanism for controlling the height of the water in the reservoir to further affect the shape of a contoured wave. FIG. 12 illustrates an exemplary cross sectional view of an exemplary wave system according to embodiments described herein. The reservoir 1200 may be segregated to include a tailwater tank 1201 (or first portion) of the reservoir below the ride area floor, and a charge tank 1202 (or second portion) that is preferably at the rear portion of the ride behind any generated wave, near the water recovery area. Alternatively, the charge tank could be located at a different location in the reservoir. For example, the charge tank could be pushed off to the side under the ride area floor, if needed. The segregation of the reservoir may be used to control the height of the tailwater of the wave generation system. The height of the tailwater may be used to control a height and/or shape of a wave. As shown, the reservoir may be defined or enclosed in a container having an outer wall and a floor. A vertical wall 1210 may separate the first portion 1201 of the reservoir from the second portion 1202 of the reservoir. The vertical wall 1210 may be positioned in a rear portion of the wave generating device, such as in the water recovery area.

Figure 13:
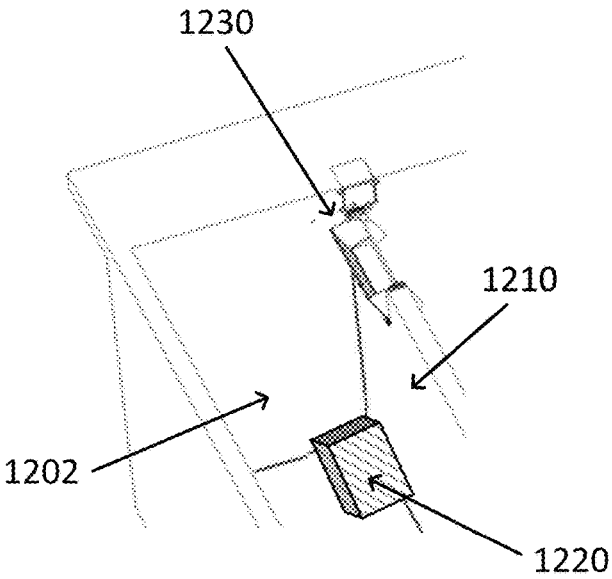
FIGS. 13-14 illustrate exemplary partial component views of the system according to embodiments described herein.
Figure 14:
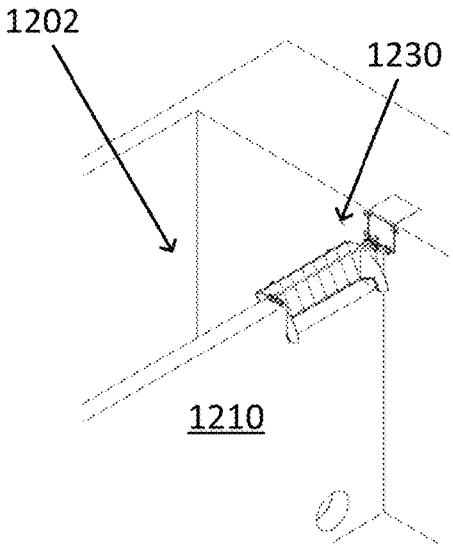

As illustrated in FIGS. 12-14, the vertical separation wall 1210 between the first portion 1201 of the reservoir and the second portion 1202 of the reservoir may control an amount of water between the two portions. As illustrated, the separation wall comprises a pump 1220 for moving water from the second portion 1202 of the reservoir, away from the ride area floor, to the first portion 1201 of the reservoir that includes an area below the ride area floor. The separation wall may also or alternatively comprise a variable surface 1230 that allows at least a portion of the top of the wall 1210 to change height. Water from the first reservoir may therefore flow over the top of the variable surface. In the embodiment depicted in FIGS. 13-14 the variable surface 1230 comprises only a relatively short length of the top of the wall. Alternatively, the variable surface could be wider or narrower, comprising the entire length of the wall, or only a portion of the width, depending on how fast the water level is desired to change. A wider variable surface 1230 would allow for faster changes in water level, while a narrower variable surface 1230 would allow for slower changes in water level. In one embodiment, a plurality of variable surfaces 1230 might be placed along the same vertical wall 1210, in which case each of the plurality of variable surfaces 1230 would preferably be adjusted by the same amount.

The variable surface may take on different forms. In the embodiment depicted in FIGS. 12-14 the variable surface 1230 is in the form of a weir gate that rotates or tips toward the second portion 1202 of the reservoir to allow water to spill over the top of the variable surface 1230. Alternatively, the variable surface 1230 might be in the form of a gate that slides up and down to change the height of the variable surface 1230. A vertically sliding variable surface 1230 might slide straight up and down, or at an angle toward or away from the second portion 1202 of the reservoir. In one embodiment, a vertically sliding variable surface 1230 might slide along the front or back of the vertical wall 1210. In another embodiment, a vertically sliding variable surface 1230 might slide into a recess formed in the vertical wall 1210.

Figure 15:
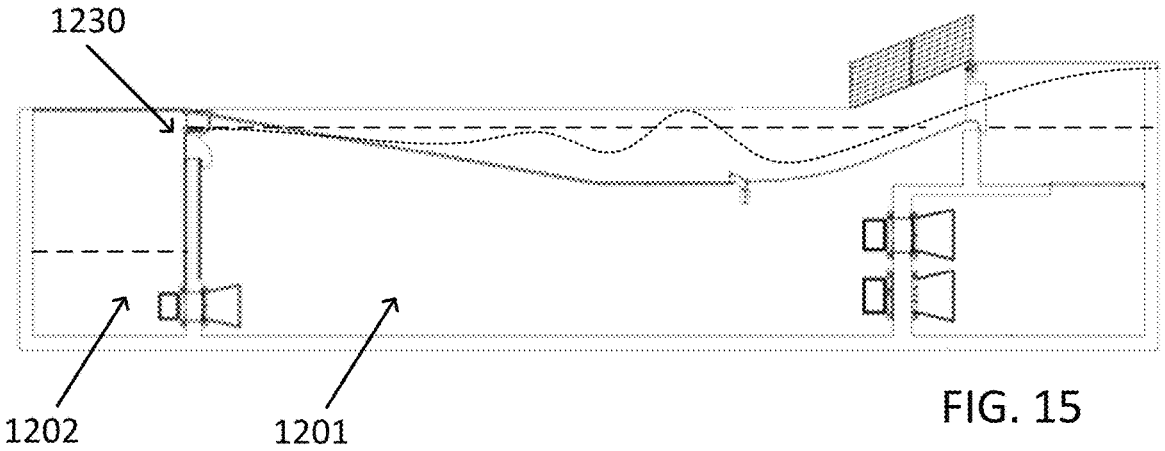
FIGS. 15-16 illustrate exemplary cross sections of embodiments employing a variable surface to control water height.
Figure 16:
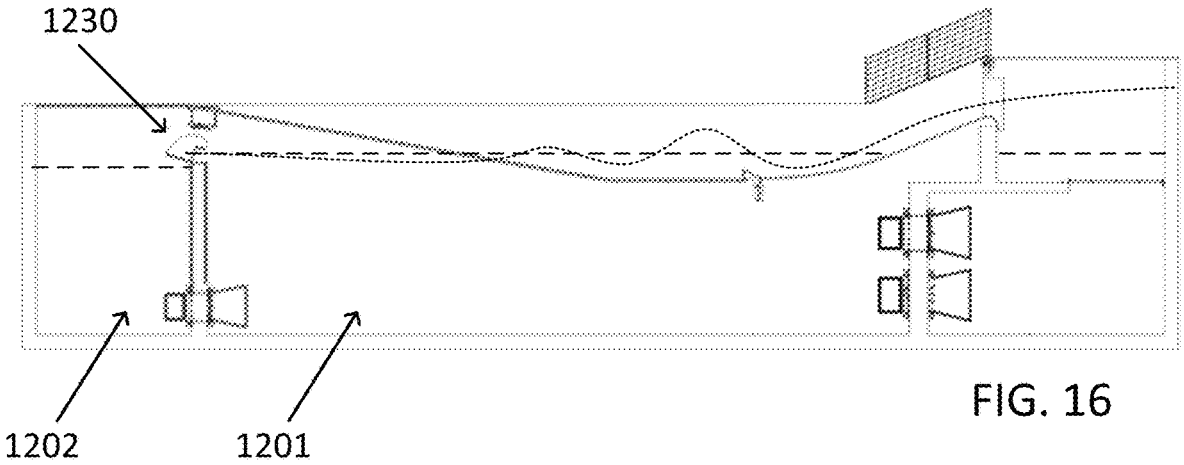

FIG. 15 illustrates an exemplary configuration of a standing wave when the variable surface 1230 is at a maximum height. FIG. 16 illustrates an exemplary configuration of a standing wave when the variable surface 1230 is at a minimum height (fully open). As shown in FIG. 15, when the variable surface of the separation wall is at a maximum, the water is contained primarily in the first portion 1201 of the reservoir, and less water is in the second portion 1202 of the reservoir. The dashed lines in FIGS. 15 and 16 indicate an estimate of the static water level. The dotted lines in FIGS. 15 and 16 indicate the wave profile during operation. When the variable surface of the separation wall is at a minimum, as in FIG. 16, the water in the second portion 1202 of the reservoir is at a maximum and the water in the first portion 1201 of the reservoir is lowered. When the variable surface is at a maximum height, the generated wave is higher, as seen in FIG. 15, and when the variable surface is at a minimum height, the generated wave is smaller, as seen in FIG. 16. Intermediate positions of the variable surface result in intermediate wave profile sizes.

Figure 17A:
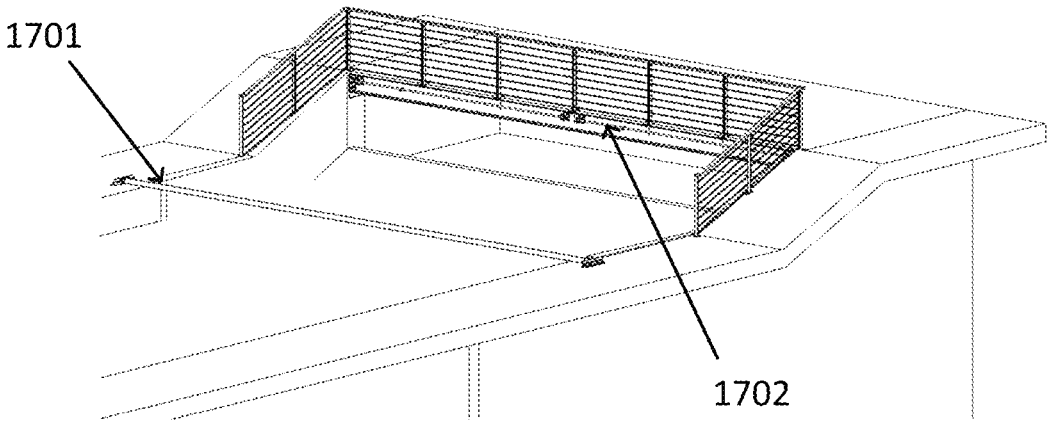
FIGS. 17A and 17B illustrate exemplary views of training components that may be used with the embodiments described herein.
Figure 17B:
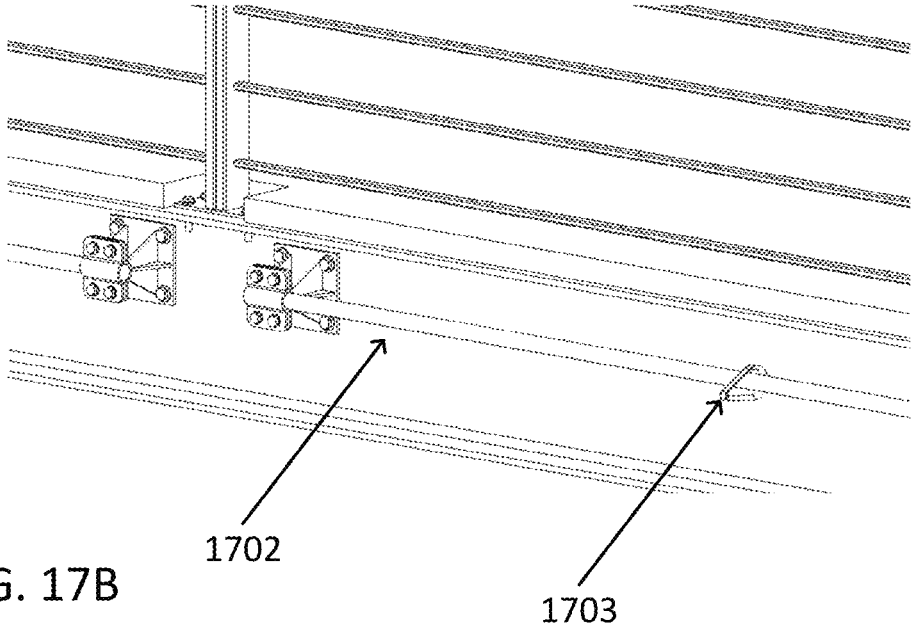

FIGS. 17A and 17B are close up views of the front of the wave generation device including a training system. The training system may include a bar 1701 that extends across the wave system reservoir and that may be held onto by a user while riding a generated wave. The system may also include a railing and harness system that may also provide a dynamic holder for a new or intermediate user. As illustrated, one or more rails 1702 may be positioned at the front of the wave generation device. The rail 1702 may support a ring 1703 or other fastening device capable of freely translating along the length of the rail. A tether and/or handle may be coupled to the loop 1703 and be held by a rider. As the rider traverses along the wave, the handle may move with the rider as it the ring 1703 translates along the rail 1702.

Figure 18A:
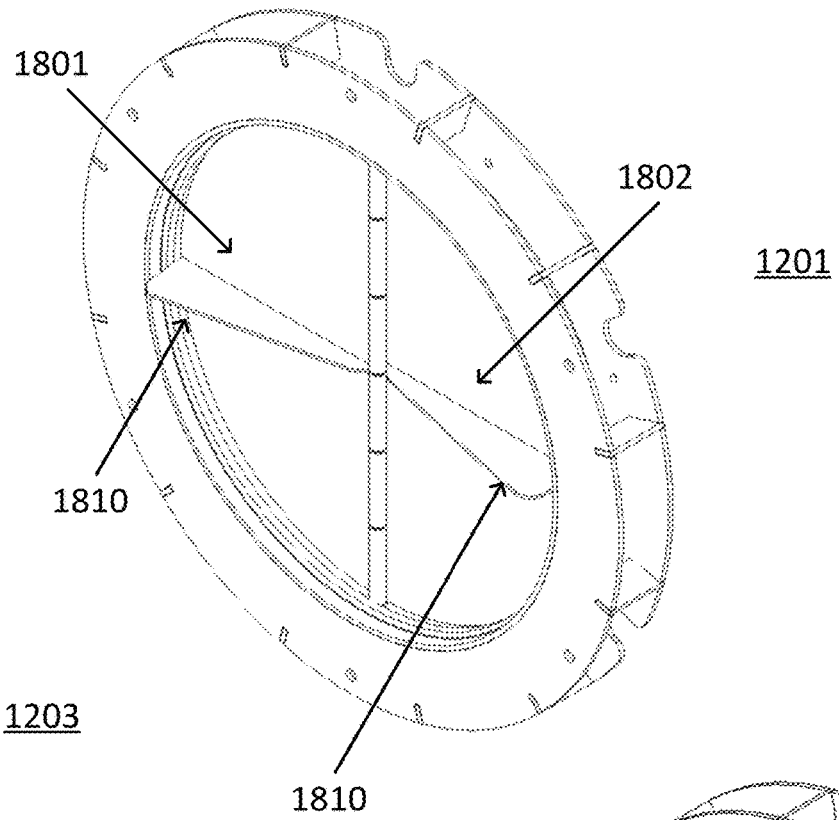
FIGS. 18A and 18B illustrate front and back perspective views of an exemplary check valve cover in closed position to be used in a system such as one designed according to embodiments described herein.
Figure 18B:
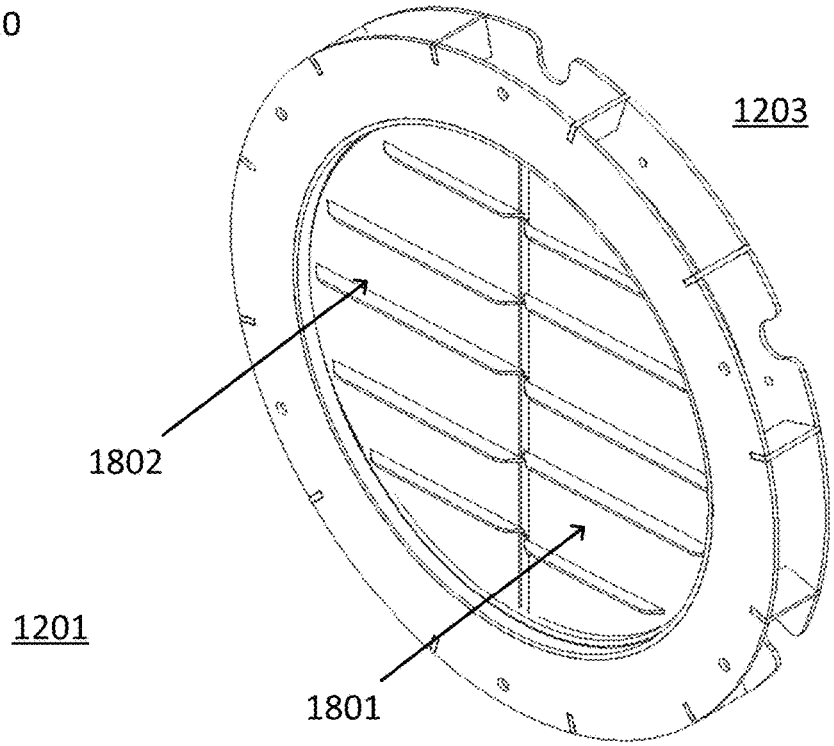

FIGS. 18 and 19 illustrate a check valve that may be used with embodiments described herein. Referring now to FIG. 12, a pump (such as pump(s) 1250 in FIG. 12) for use in the deep wave system described herein, may include a check valve covering that can close to reduce the backflow of water in the event the pump turns off or fails. During normal operation, water is pumped from tailwater tank 1201 into headwater tank 1203. When the pump 1250 turns off, water may reverse flow back through the dormant pump 1250 from the headwater tank 1203 to the tailwater tank 1201. This can damage the pump due to, for example, counter-rotation of the pump blades. The check valve described herein is designed to alleviate or prevent damage caused by backflow of water. The check valve may also prevent pressure loss during operation in the headwater tank 1203 allowing the ride to continue regular operation even given inoperability of one pump.

As illustrated in FIGS. 18A, 18B, 19A, and 19B, the covering includes one or more doors 1801, 1802 that can cover the opening of the pump on an outlet when the water begins to flow back toward or through the pump. In the views in FIGS. 18A and 18B, the pump is not shown. The pump and tailwater tank 1201 would be located on the right-hand side of FIGS. 18A and 19A, with water flowing from right to left during normal operation. The pump and tailwater tank 1201 would be located on the on the left hand side of FIGS. 18B and 19B, with water flowing from left to right during normal operation.

In a preferred embodiment, the check valve cover includes two doors hinged vertically at the midpoint of the cover, as shown in FIGS. 18A, 18B, 19A, and 19B. The doors 1801, 1802 are configured to rotate toward each other in a first direction. During normal flow, water flows from tailwater tank 1201 into headwater tank 1203 toward or into the pump. The force of the moving water pushes the doors open (FIGS. 19A, 19B), opening the cover. Ribs on the pump-facing side of the doors may be included to provide additional structural strength to the doors 1801, 1802.

Figure 19A:
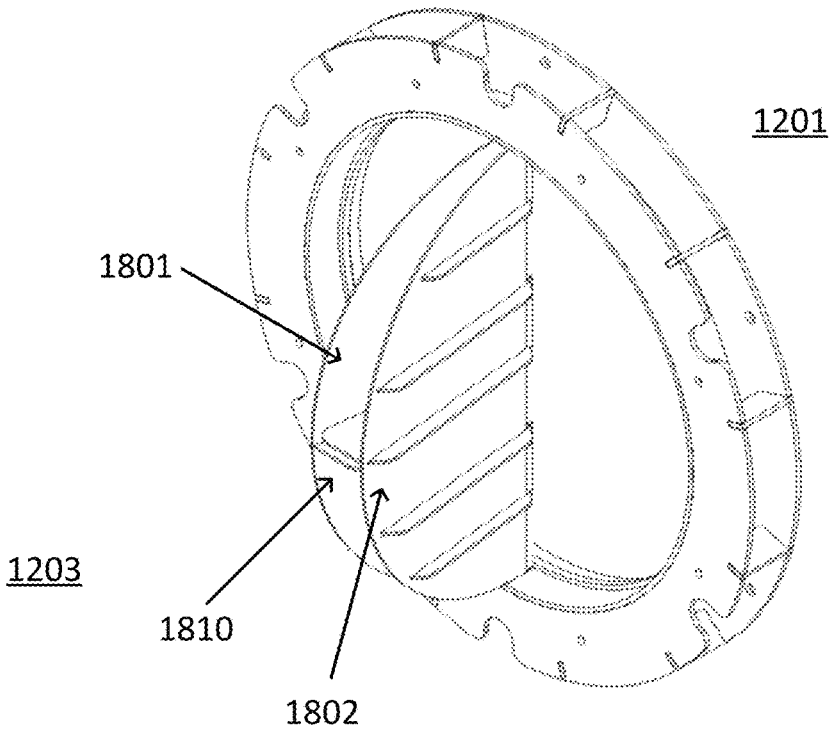
FIGS. 19A and 19B illustrate front and back perspective views of an exemplary check valve cover in open position to be used in a system such as one designed according to embodiments described herein.
Figure 19B:
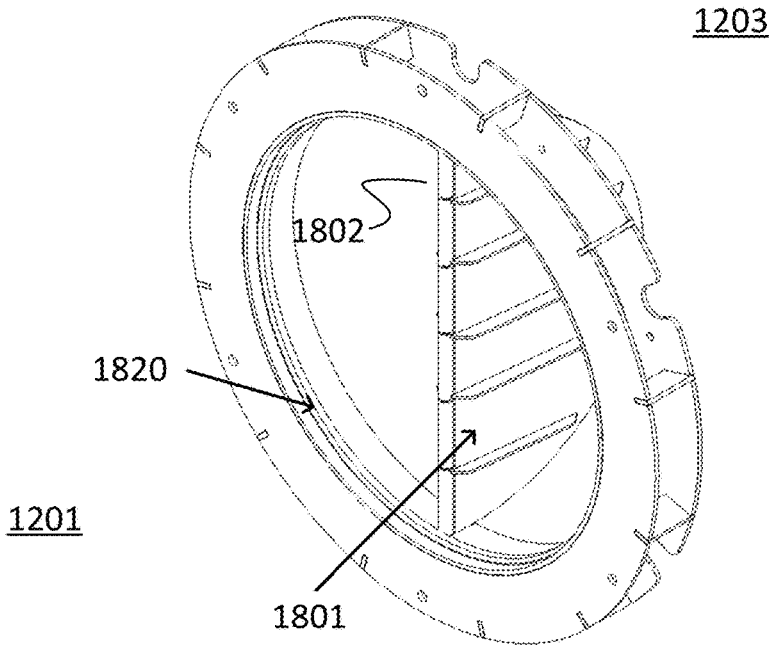

The rear-facing side of each door includes a rear projection 1810 extending outward (FIG. 18A) so that the facing surfaces do not directly contact when open (FIG. 19A). In alternate embodiments, multiple rear projections on the rear-facing side of each door may be used, or the projections may take a different a different shape than is illustrated here. When the check valve cover is open (FIG. 19A) the rear projections 1810 contact the rear-facing surface of the opposing door, creating a space between the rear-facing surfaces of the doors.

When backflow occurs, water flows back through the pump from the headwater tank 1203 into the tailwater tank 1201, closing the doors. Due to the weight of the doors and the relatively weak force of backflow, the backflow alone may not have sufficient force to close the doors. The rear projection 1810 on the rear-facing side of the doors prevents the open doors 1801, 1802 from fully touching, thus increasing the surface area of the doors subject to the force of the backflowing water and ensuring that they close and increasing the speed at which they close. In this manner, the check valve cover is entirely self-actuating, with no need for additional mechanical or electric input to open or close the doors.

Preferably, the check valve cover will include a raised portion 1820 running along the inner perimeter of the cover. The raised portion acts as a stop so that during backflow, the doors 1801, 1802 will stop at the closed position, rather than continuing to re-open in a reverse direction. Alternatively, the raised portion may not run along the entire inner perimeter of the cover. The raised portion may be intermittent or may comprise one or more raised features located in the perimeter of the cover to stop the doors at the closed position, (e.g., feature 2020 in FIG. 20A).

Figure 20A:
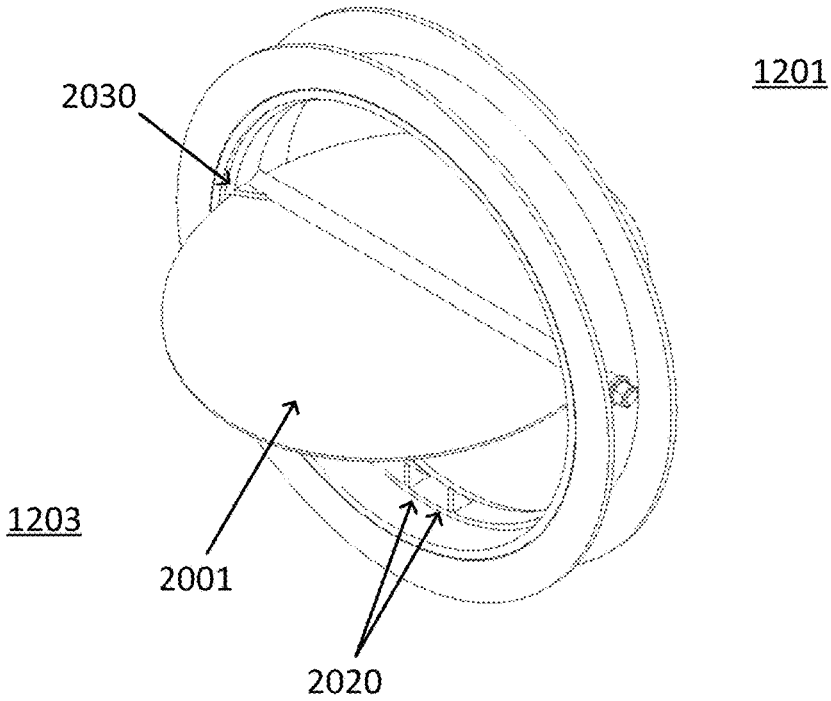
FIGS. 20A and 20B illustrate front and back perspective views of an exemplary check valve cover in open and closed positions to be used in a system such as one designed according to embodiments described herein.
Figure 20B:
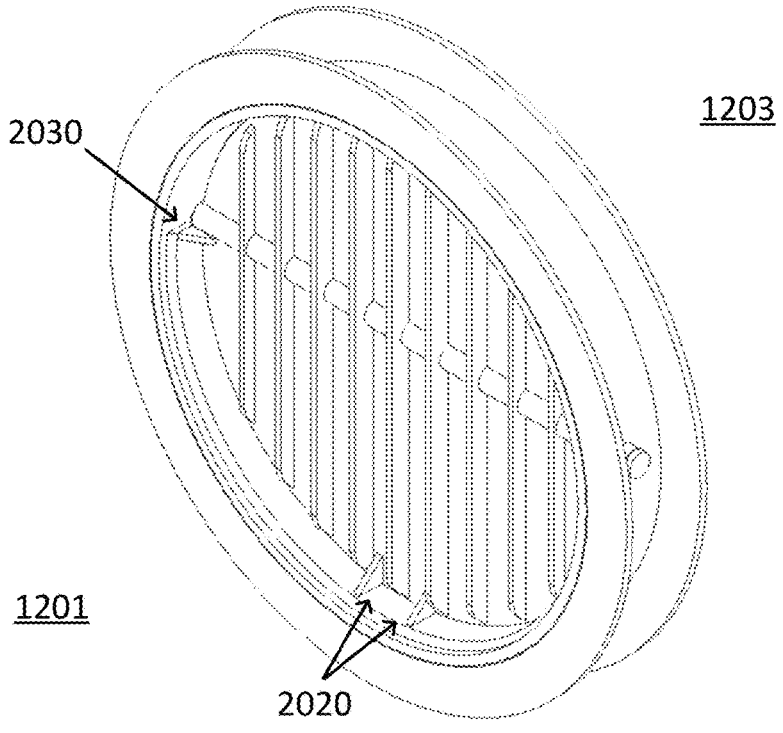

In an alternative embodiment of the check valve cover, a single door 2001 may be employed, with a hinge running horizontally through the door, as shown in FIGS. 20A and 20B. The hinge running horizontally through the door is preferably offset somewhat above the midpoint of the door, which allows the water flowing from right to left in FIG. 20A to create more force on the bottom side of the door, causing it to open. During normal flow the door would rotate open to allow water to flow through the pump to the headwater tank. A raised projection 2030 may be included on the inner perimeter of the check valve cover to prevent the door from opening more than 90° and/or to prevent the door from spinning. During backflow, the loss of water pressure would cause the hinged door to fall closed.

Although the check valve covers are described herein in connection with pumps for a water attraction, their use need not be limited to this application and instead may be used in any application requiring a large scale, self-actualizing check valve for water applications.

Although embodiments of this invention have been fully described with reference to the accompanying drawings, it is to be noted that various changes and modifications will become apparent to those skilled in the art. Such changes and modifications are to be understood as being included within the scope of embodiments of this invention as defined by the appended claims. Specifically, exemplary components are described herein. Any combination of these components may be used in any combination. For example, any component, feature, step or part may be integrated, separated, sub-divided, removed, duplicated, added, or used in any combination and remain within the scope of the present disclosure. Embodiments are exemplary only, and provide an illustrative combination of features, but are not limited thereto.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A wave system, comprising:

a water outlet for water to flow onto a ride area, the ride area comprising a ride area floor;

a controller for adjusting an amount of water to be released onto the ride area;

an obstacle in the water flow path on the ride area, the obstacle configured to generate a surface contour on a surface of the water flowing over the obstacle; and a water recovery for removing the water from the ride area;

a reservoir below the ride area floor, whereby water is recirculated from the water recovery to the water outlet through the reservoir, the reservoir comprising a first and second reservoir areas separated by a separation wall extending from the bottom of the reservoir to the ride area floor;

wherein at least a portion of the separation wall comprises a variable surface configured to control a height of a tailwater of the wave system, the variable surface is configured to allow at least a portion of a top of the separation wall to change a height of the separation wall by way of being moved to at least a first position and a second position, wherein the top of the variable surface in the second position is lower than the top of the variable surface in the first position, wherein the controller actuates the variable surface to adjust the height of the tailwater thereby controlling a height of the water on the ride area.

2. The wave system of any of claim 1, wherein the variable surface is a weir gate.

3. The wave system of any of claim 1, wherein the variable surface is a gate configured to translate vertically.

4. The wave system of any of claim 1, further comprising one or more pumps within the reservoir for moving the water to the water outlet.

5. The wave system of any of claim 1, wherein the obstacle comprises an upwardly inclined surface.

6. The wave system of any of claim 1, further comprising a water conditioner within or adjacent to the reservoir.

7. The wave system of claim 1, wherein the variable surface is capable of being moved to a third position wherein the top of the variable surface is at a height between the height in the first position and the height in the second position.

* * * * *